United States Patent [19]

Le Tixerant

[11] Patent Number: 4,800,709

[45] Date of Patent: Jan. 31, 1989

[54] ARRANGEMENT FOR SETTING BACK THE SEAT OF AN EQUESTRIAN SADDLE AND A DAMPING DEVICE ADAPTED TO BE FITTED TO SAID ARRANGEMENT

[76] Inventor: Eric Le Tixerant, 8 Rue Erlanger, 75008 Paris, France

[21] Appl. No.: 906,823

[22] Filed: Sep. 12, 1986

[30] Foreign Application Priority Data

| | | | |
|---|---|---|---|
| Sep. 19, 1985 | [FR] | France | 85 13874 |
| Dec. 2, 1985 | [FR] | France | 85 17791 |
| Aug. 25, 1986 | [FR] | France | 86 12015 |

[51] Int. Cl.[4] ..... B68C 1/00

[52] U.S. Cl. ..... 54/44; 54/66

[58] Field of Search ..... 54/23, 37, 44, 46, 65, 54/66

[56] References Cited

U.S. PATENT DOCUMENTS

| | | | |
|---|---|---|---|
| 4,061 | 5/1845 | Caldwell | 54/44 |
| 4,142 | 8/1845 | Suits | 54/44 |
| 362,707 | 5/1887 | Bergman | 54/44 |
| 532,419 | 1/1895 | Haines, Jr. | 54/66 |
| 753,751 | 3/1904 | Stern | 54/44 |
| 1,246,675 | 11/1917 | Stewart | 54/44 |
| 3,323,287 | 12/1965 | Hilmer | 54/66 |
| 4,136,506 | 1/1979 | Miller | 54/66 |
| 4,502,266 | 3/1985 | Friedson | 54/44 |

FOREIGN PATENT DOCUMENTS

| | | | |
|---|---|---|---|
| 2495124 | 6/1982 | France | 54/66 |
| 262995 | 12/1926 | United Kingdom | 54/66 |
| 390677 | 4/1933 | United Kingdom | 54/66 |
| 853628 | 5/1959 | United Kingdom | 54/46 |

*Primary Examiner*—Robert P. Swiatek
*Assistant Examiner*—R. Thomas Price
*Attorney, Agent, or Firm*—Watson, Cole, Grindle & Watson

[57] ABSTRACT

An equestrian saddle which includes a saddle frame having a plurality of straps hanging down from opposite sides thereof, a seat mounted on the saddle frame, a left and right side panels located beneath the saddle frame, a girth which includes a plurality strap buckles for connection to the straps, and an elongated saddle cloth located beneath the left and right side panels, the saddle cloth having left and right side portions which each include a pad on an inner surface thereof for extending into an associated hollow in a horse's shoulder and an abutment element on an outer surface thereof against which a front edge of the associated left or right side panel can abut to maintain the saddle over the 13$^{th}$ and 14$^{th}$ dorsal vertebrae of the backbone of the horse.

9 Claims, 3 Drawing Sheets

ARRANGEMENT FOR SETTING BACK THE SEAT OF AN EQUESTRIAN SADDLE AND A DAMPING DEVICE ADAPTED TO BE FITTED TO SAID ARRANGEMENT

BACKGROUND OF THE INVENTION

The invention relates to an arrangement for setting back the seat of an equestrian saddle, the latter being held at the front by stop means cooperating with the shoulders of the horse and optionally being fixed on the horse's back by a girth whose ends carry strap buckles cooperating with girth straps fixed on the saddle, and to a damping device adapted to be fitted to the arrangement.

The saddle is held on the horse's back by a girth which passes over a very precisely defined zone of the horse's body known as the girth line, towards which zone the saddle tends to reposition itself because of the morphology of the horse. In order to prevent the saddle from being displaced in the forward direction, it is provided with paddings serving as stops and supported in the hollows of the shoulders. The seat is then generally positioned vertically in line with the zone centered on the ninth dorsal vertebra, and the latter has to support the weight of the rider.

The position of the saddle is too far forward in relation to the centre of gravity of the horse, and workouts or training are intended, among other objects, to develop a musculature capable of compensating for this unbalance and to enable the horse to regain its natural gait.

Unfortunately, workouts for young horses end too often in a restriction of shoulder movement. It is not rare for a rider to be disappointed because his horse has lost a part of the good stepping which it showed in the meadow.

Practically all these animals have the same bone injury consisting of a blockage of one or more of the vertebrae of the withers (dorsal vertebrae 3 to 8). Study of the vertebral column of the horse (FIG. 1) leads to two findings: the apex of the curve of the vertebral bodies is at the 13th and 14th dorsal vertebrae, in which zone the top line is at its lowest; the shortest spinous processes are those of these same vertebrae.

The rider's weight is applied to the horse at a point resulting from the position of his seat and of the attachment of the stirrup leathers carrying the stirrups. When the horse is not sufficiently muscular, the rider's weight tends to weigh down the zone of the vertebral column situated under the saddle.

For the reasons explained above, the position of the saddle (FIG. 2) is such that the weight is applied at the 9th dorsal vertebra and the entire withers zone is weighed down, because the vertebral processes in that zone have a natural forward dip. Because of the great length of the spinous processes of the withers, the slightest lowering of this region brings them into contact with one another and gives rise to symptoms of interspinal osteoarthritis. This condition is very painful and is then self-sustaining, while the pain results in a reflex spasm of the muscles of the intervertebral joints.

SUMMARY OF THE INVENTION

The invention seeks to provide an arrangement for setting back the saddle seat so as to enable the rider's weight to be moved back to the zone of the 13th dorsal vertebra, which is the strongest zone of the vertebral column, considering without muscles, and the zone in which subsidence is the least painful because the spinous processes are shortest in that region. Means are known which make it possible to hold a saddle in its conventional position in the event of malformation or incomplete growth of the withers of a horse. In these cases, in fact, the hollows of the shoulders are not sufficiently formed to enable the saddle padding to be received in them and to prevent the saddle from moving forward. Use in then made of false withers in the form of a surcingle carrying stops against which the front of the saddle panels come to bear. The surcingle then occupies the girth line, and the girth holding the saddle is placed behind it over a zone of rib mobility, thus entailing the disadvantage that the thorax is compressed.

Since the false withers are independent of the saddle, the exercising of the horse results in the pushing of the saddle forwards, with the consequence that the false withers are urged forward and that discomfort is frequently caused at the elbow, together with injury to the breast-forearm fold.

Despite numerous attempts made hitherto to set the saddle back and avoid the disadvantages of false withers, no satisfactory solution has been found to this problem.

Still with the object of avoiding disorders of the vertebral column and minimizing shocks due to the rebounding of the rider on the saddle during different gaits, and thus increasing the comfort of rider and horse, certain saddles are equipped with directly or indirectly fixed damping means. These damping means consist of sheets of elastic foam or air cushions.

The major disadvantage arising with such systems is due to the fact that the saddle cloth or saddle must be adapted to the morphology of the horse. Consequently, to be effective the saddle cloth or saddle must be personalized. Because of the unitary design of the damper and the saddle or saddle cloth, the system must be made to measure by a saddlemaker. This means heavy expense, thus limiting the use of this system to high quality saddlery products. Furthermore, the resulting arrangement does not permit easy maintenance.

The invention proposes an arrangement for setting back a saddle which avoids the disadvantages mentioned above by utilizing stop means cooperating with the horse's shoulders, against which stop means the front of the saddle is held, the stop means being independent of or fastened to the saddle and optionally held by the saddle girth.

In one embodiment the stop means are carried by the front edge of a saddle cloth and consist, on the inside, of the padding cooperating with the hollow of the horse's shoulders and, on the outside, of stops against which the front of the panels comes to bear.

In another embodiment the stop means and the saddle are held by a single girth provided at its ends, on its rear longitudinal edge, with a part which projects rearwards and on which are provided strap buckles adapted to cooperate with straps on the saddle and, near and approximately parallel to its front longitudinal edge, with at least one front fastening means cooperating with the stop means.

The invention further proposes an adjustable damping device adapted to be placed between the saddle setback arrangement and the saddle, and comprising at least one pocket holding the damping material and provided along a median line with rapid-fastening means permitting adjustment of its longitudinal position on the additional fastening means provided on the dorsal line of the saddle cloth.

The following decription referring to the accompanying drawings, which are given by way of example, will enable it to be understood how the invention can be applied.

DETAILED DESCRIPTION OF THE PREFERRED EMBODIMENTS

Figure 1:
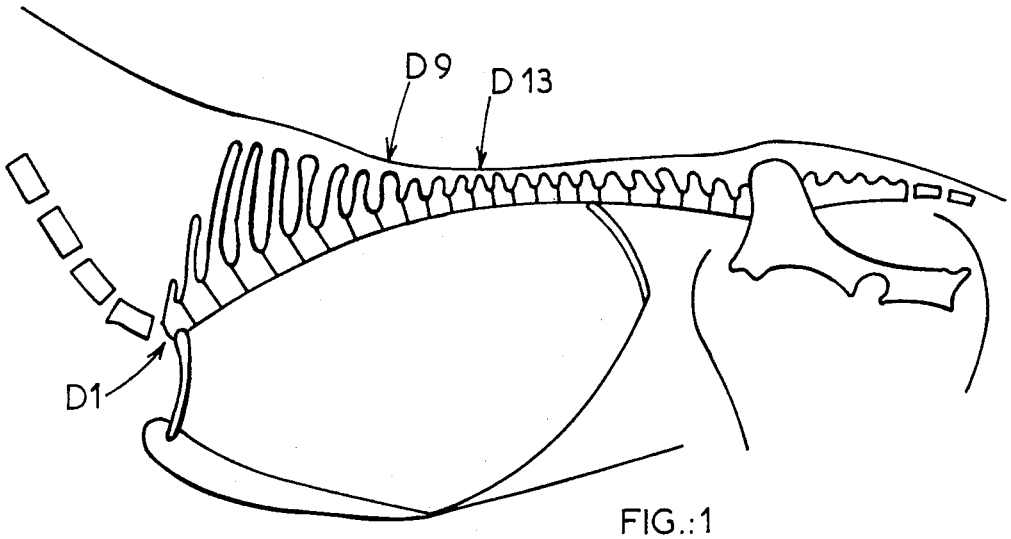
FIG. 1 is a partial view of the skeleton of a horse, more particularly of its vertebral column.
Figure 2:
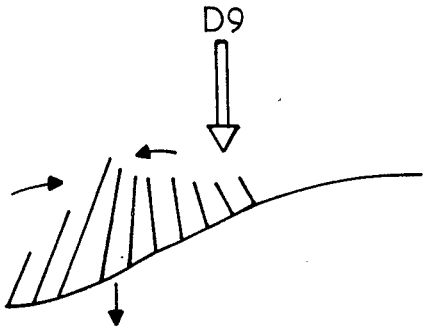
FIG. 2 shows schematically the action of a saddle in the conventional position on the vertebrae of a horse.

As previously explained in connection with FIGS. 1 and 2, the conventional position of a saddle, resulting from the obligatory path of the girth fastened indirectly to the bands (also known as side bars) which help form the frame of the saddle, has the consequence of applying the rider's weight in the region of the 9th dorsal vertebra, and entails disadvantages in respect of the vertebral processes.

Figure 5:
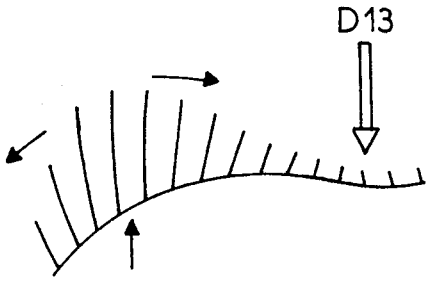
FIG. 5 shows schematically the action of a saddle in the set-back position on the vertebrae of a horse.

The arrangement for setting back a saddle according to the invention applies the rider's weight in the region of the 13th and 14th dorsal vertebrae (FIG. 5), which is the keystone of the vertebral column and the strongest zone of the rachis, even disregarding the muscles.

Any subsidence, however slight, which may occur in this zone has the effect of moving apart the processes of the withers region and has a beneficial effect on the entire action of the horse. This spreading-out in fact entails the deconstruction of the shoulder muscles, freeing the movements of the latter, and easier upward movement of the withers, which means the stretching of the entire rachis.

Figure 3:
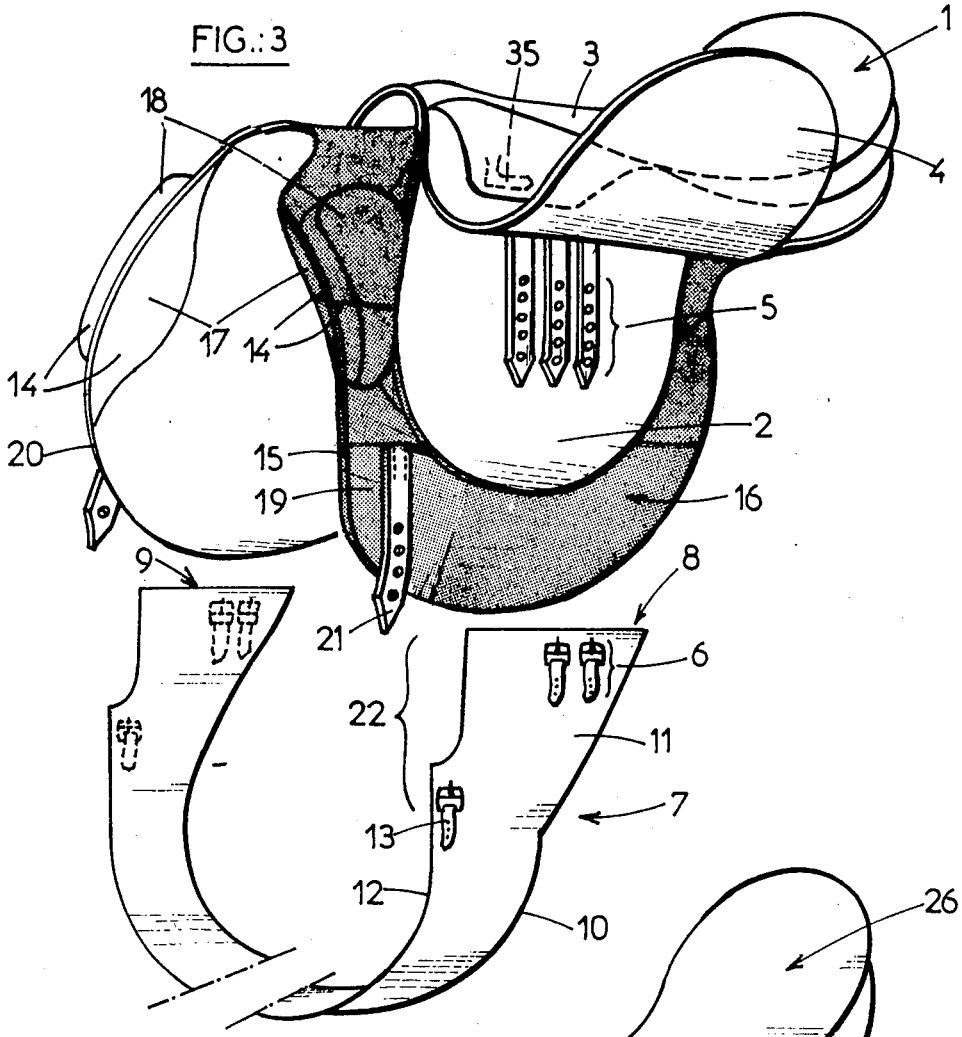
FIG. 3 shows a first example of construction of an arrangement according to the invention.

FIG. 3 shows a first example of construction of the arrangement according to the invention; a conventional saddle 1 normally comprises a saddle frame consisting of a front pommel and a rear cantle connected by bands (not shown). Under the pommel, cantel and bands are housed, on each side, cushions or panels 2. The seat 3, which is the part on which the rider sits, is disposed between the pommel and the cantle. On the bands are fixed the flaps 4, which cover and protect the panels. On the bands are also fixed the straps 5, to which will be attached the strap buckles 6 on the girth 7 serving to secure the saddle, as well as the stirrup leather holders 35.

The flaps are covered by rolls. The front end of the panels carries, on the inside, padding which will be received in the hollows of the horse's shoulders in order to prevent the saddle from moving forward. Because of the need to pass the girth along the girth line and to fix it approximately vertically in line with the seat in order to hold it securely on the horse's back and to prevent it from slipping off the horse's back when the horse is exercised, it is not possible to shift the girth straps in the direction of the pommel. The three following conditions: the girth on the girth line, the girth straps facing strap buckles for fastening thereto, and the seat on the 13th and 14th dorsal vertebrae, cannot all be simultaneously fulfilled with known arrangements.

The arrangement for setting back a saddle according to the invention complies with these three conditions by the use of stop means 14 which, in the embodiment shown in FIG. 3, comprise a girth 7 (FIG. 3) which at its ends 8, 9 is provided, on its rear longitudinal edge 10, with a rearwardly-projecting portion 11 on which are provided strap buckles 6 adapted to cooperate with the girth straps 5 on the saddle and, near and approximately parallel to its front longitudinal edge 12, with at least one front fastening buckle 13 adapted to cooperate with stop means 14 to hold the latter against the horse's shoulders.

Figure 6:
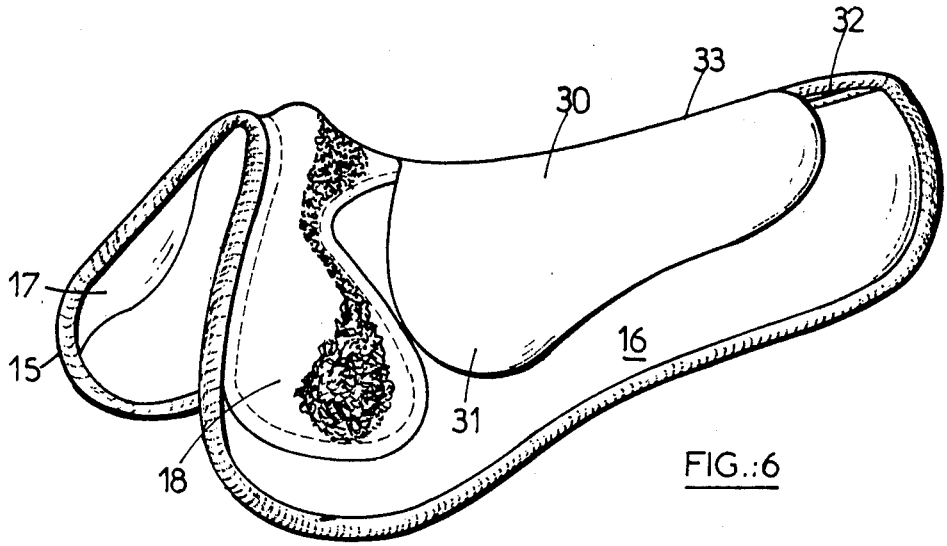
FIG. 6 shows a first example of construction of a damping device according to the invention.
Figure 7:
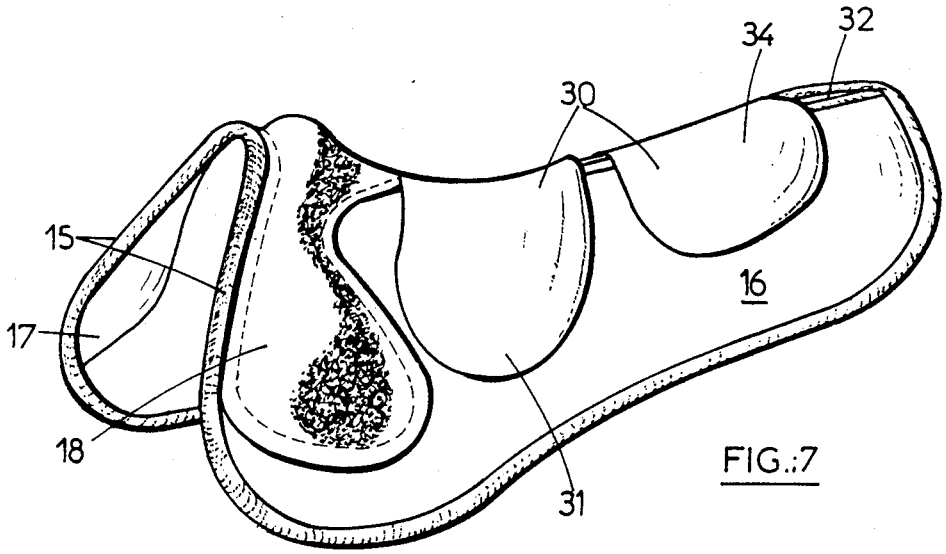
FIG. 7 shows a second example of construction of a dampening device according to the invention.

In the embodiment illustrated in FIGS. 3, 6 and 7 the stop means are carried by the front edge 15 of a saddle cloth 16 and consist, on the inside, of paddings 17 cooperating with the hollow of the horse's shoulders and, on the outside, of stops 18 against which the front of the panels 2 comes to bear.

In the embodiment shown in FIG. 3 the front ends 19, 20 of the saddle cloth carry fastening straps 21 complementary to the front fastening buckles 13 provided at the ends of the girth 7. The saddle cloth straps 21 are preferably fixed in such a manner as to be in line with one another, the straight line joining them passing behind the stops 18 and the horse's withers. Vertically in line with the withers of the horse the saddle cloth may optionally be reinforced or cut out (not shown) to free the withers.

In the example of construction of the girth shown in FIG. 3, the rearwardly-projecting portions 11 form a right-angled triangle in which the shorter side of the right angle is in alignment with the edge 8 and 9 of the end of the girth and approximately perpendicular to the rear longitudinal edge 10. The trapezoidal portion 22 of the girth is preferably made of a relatively rigid material and must be of slight length in order not to hinder the horse's breathing.

The saddle cloth carrying the stop means constitutes in itself a setback cloth which can be held in conventional manner by the saddle and the saddle girth, in which case the fastening means are constituted by the saddle and saddle girth.

Figure 4:
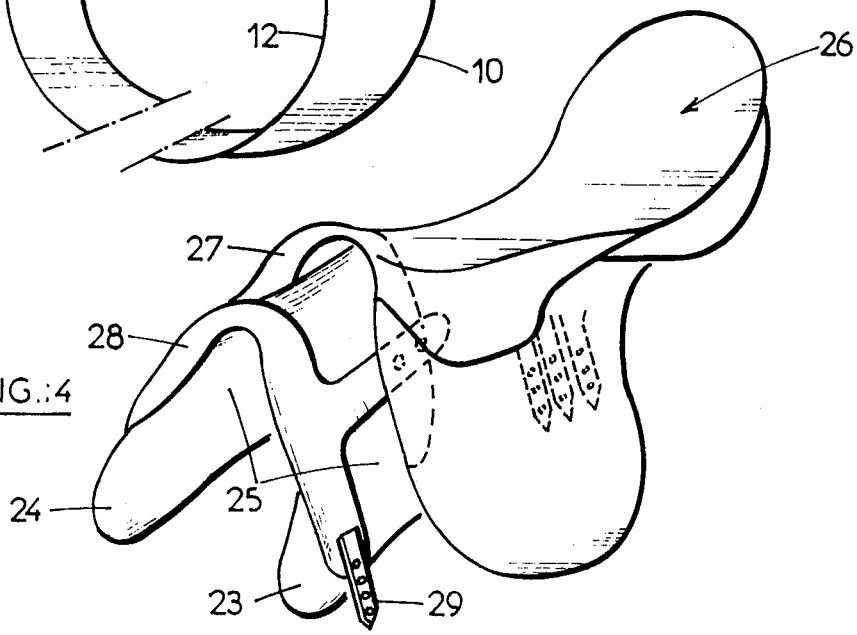
FIG. 4 shows a second example of construction of an arrangement according to the invention.

FIG. 4 shows a second example of construction of an arrangement for setting back a saddle according to the invention, in which the stop means consist of the front paddings 23 and 24 of the panels 25 of a saddle composed of a normal saddle frame 26, on whose pommel 27 is mounted fixedly or movably a pommel extension 28 whose sides carry the means 29 complementary to the front fastening buckle 13 on the ends of the girth 7. The pommel extension 28 may be adjustable in length so as to allow adjustment of the distance of the seat from the hollows of the shoulders in which the paddings forming stops are to be placed, thus taking into account the morphology of the horse. If the pommel extension is adjustable, it may be provided with panels independent of those of the saddle frame supporting the seat.

In one example, which is not illustrated, the saddle frame has a length such that the seat is situated vertically in line with the 13th and 14th dorsal vertebrae, while the panel paddings are received in the shoulder hollows. The frame carries girth straps vertically in line with the seat, the sides of the pommel, and the means complementary to the front fastening buckles 13 on the ends of the girth 7.

In the embodiments shown in FIGS. 3, 6 and 7 the stops 18 disposed on the outside of the saddle cloth are detachable to enable them to be changed for different horses, since the distance between the shoulder hollows and the 13th and 14th dorsal vertebrae may vary from one horse to another.

In another embodiment these stops may be longitudinally adjustable.

It should be observed that the position of the saddle is determined not only by the distance from the stops to the seat, but also by the distance from the strap buckles on the girth to the front fastening buckles 13. In order to make this distance adjustable, a certain number of strap buckles are provided to permit gradual longitudinal displacement of the order of some ten centimeters towards the rear, corresponding approximately to the average distance between the 9th dorsal vertebra (conventional saddle position) and the 13th and 14th dorsal vertebrae (set-back position).

The damping device 30 (FIGS. 6 and 7) according to the invention, which is adapted to be fitted to the setback arrangements described above, and in particular to the setback saddle cloth 16, is in the form of a saddle cloth composed of at least one pocket (pillow-like container) in which the damping material is placed.

The device according to the example shown in FIG. 6 is provided at the front with two lobes 31, which are placed symmetrically on the cloth 16, one on each side of the dorsal line 32.

Along the median line 33 of the damping device fastening means (not shown) are provided which cooperate with complementary fastening means (not shown) fixed along the dorsal line 32 of the cloth. The complementary fastening means are preferably composed of "VELCRO" pads, which permit adjustable longitudinal positioning of the damping device relative to the cloth 16. In order to permit the insertion of the damping material the pocket is open, for example, along its median line. The material is in the form of a panel of dimensions corresponding to those of the pocket, or of fragments of larger or smaller dimensions, rapid closure means being provided for the openings.

In another embodiment, shown in FIG. 7, the damping device is divided transversely into two pockets, namely a front pocket forming the lobes 31 and a rear pocket 34. Each of the pockets carries a rapid fastening system cooperating with a complementary fastening system provided on the dorsal line of the saddle cloth.

This two-part construction makes it possible to adapt the damping device accurately and independently to the morphology of the horse.

The use of open pokets or pockets having rapid fastening means makes it possible to use damping materials of different qualities or varying thicknesses, as well as cushions having zones with different damping properties, thus permitting simple and rapid compensation, during saddling, for morphological differences, or enabling the degree of damping to be adjusted in accordance with the sensitivity of different anatomical zones of the horse.

In one example of embodiment the damping material is a polyurethane elastomer, such as that known under the name "SORBOTHANE".

The damping device of the kind described may be used with conventional saddle cloths, and in this case may serve not only as damping means but also, depending on the type of saddle used, as setback stops.

The invention is not limited to the examples of embodiment described, but also covers all technical equivalents.

I claim:

1. An equestrian saddle which is constructed such that, when fixedly positioned on the back of a horse, the weight of a rider sitting therein will be over the 13th and 14th dorsal vertebrae of the backbone of the horse, said equestrian saddle comprising a saddle frame which has a forward end, a rearward end and opposite left and right sides, a seat mounted on said saddle frame for supporting a rider, a plurality of fastening means attached to the respective left and right sides of said saddle frame, left and right side panels located beneath said saddle frame and said plurality of fastening means, said left and right side panels defining front edges, an elongated saddle cloth located beneath said left and right side panels, said saddle cloth providing a left portion located beneath said left side panel and a right portion located beneath said right side panel, said left and right side portions of said saddle cloth having outer and inner surfaces and defining front edges which are positionable forwardly of the front edges of said left and right side panels, each of said left and right portions of said saddle cloth including a fastening means, a girth which can extend around the underside of a horse, said girth having first and second end portions, each of said first and second end portions including (1) a plurality of rear fastening means for connection with said fastening means attached to the respective left and right sides of said saddle frame, and (2) a front fastening means for connection with the fastening means of the associated left or right portion of said saddle cloth, a pad attached to the inner surface of each of the left and right portions of said saddle cloth for extending into an associated hollow of a horse's shoulder, and an abutment element attached to the outer surface of each of the left and right portions of said saddle cloth, against a rearward edge of which the front edge of the associated left or right side panel abuts.

2. An equestrian saddle which is constructed such that, when fixedly positioned on the back of a horse, the weight of a rider sitting therein will be over the 13th and 14th dorsal vertebrae of the backbone of the horse, said equestrian saddle comprising a saddle frame which has a forward end, a rearward end and opposite left and right sides, a seat mounted on said saddle frame of supporting a rider, a plurality of fastening means attached to the respective left and right sides of said saddle frame, left and right side panels located beneath said saddle frame and said plurality of fastening means, said left and right side panels defining front edges, an extension element attached to said saddle frame to extend forwardly thereof, said extension element comprising a pommel extension and left and right side panels, each of said left and right side panels having a forwardly-projecting end that can extend into an associated hollow of a horse's shoulder, said pommel extension including a fastening means on opposite sides thereof, and a girth which can extend around the underside of a horse, said girth having first and second end portions, each of said first and second end portions including (1) a plurality of rear fastening means for connection with said fastening means attached to the respective left and right sides of said saddle frame, and (2) a front fastening means for connection with the fastening means on the associated left and right sides of said pommel extension.

3. An equestrian saddle which is constructed such that, when fixedly positioned on the back of the horse, the weight of the rider sitting therein will be over the $13^{th}$ and $14^{th}$ dorsal vertebrae of the backbone of the horse, said equestrian saddle comprising:

a saddle frame which has a forward end, a rearward end and opposite left and right sides;

a seat mounted on said saddle frame for supporting the rider;

a plurality of fastening means attached to the respective left and right sides of said saddle frame;

left and right side panels located beneath said saddle frame and said plurality of fastening means, said left and right side panels defining front edges;

an elongated saddle cloth located beneath said left and right side panels, said saddle cloth providing a left portion located beneath said left side panel and a right portion located beneath said right side panel, said left and right side portions of said saddle cloth having outer and inner surfaces and defining front edges which are positionable forwardly of the front edges of said left and right side panels;

a girth which can pass over a girth line of the horse, said girth having first and second end portions, each of said first and second end portions including a plurality of fastening means for connection with said fastening means attached to the respective left and right sides of said saddle frame;

a pad attached to the inner surface of each of the left and right portions of said saddle cloth for extending into an associated hollow of a horse's shoulder, and an abutment element attached to the outer surface of each of the left and right portions of said saddle cloth, against a rearward edge of which the front edge of the associated left or right side panel abuts.

4. An equestrian saddle according to claim 3, wherein said girth provides a front longitudinal edge and a rear longitudinal edge, wherein said end portions of said girth include sections which project rearwardly of said rear longitudinal edge, and wherein said plurality of fastening means on each of said first and second end portions of said girth comprise a plurality of strap buckles attached to said rearwardly-projecting sections.

5. An equestrian saddle according to claim 4, wherein each said rearwardly-projecting section is shaped as a right triangle, the shortest side of which extends perpendicularly to said rear longitudinal edge.

6. An equestrian saddle according to claim 3, including damping means located between said elongated saddle cloth and said left and right side panels.

7. An equestrian saddle according to claim 6, wherein said damping means comprises a pillow-like container which is attachable to said elongated saddle cloth and which has two lobes that respectively extend under said left and right side panels, and a damping material contained in each lobe of said pillow-like container.

8. An equestrian saddle according to claim 6, wherein said damping means comprises first and second pillow-like containers which are independently attachable to said elongated saddle cloth, said first pillow-like container having two lobes that respectively extend under said left and right side panels, a first damping material in the lobes of said first pillow-like container, and a second damping material in said second pillow-like container, said first and second damping materials having different characteristics.

9. An equestrian saddle according to claim 6, wherein the front edge of said elongated saddle includes a cut out portion centered along a center line thereof to uncover a horse's withers when said equestrian saddle is mounted on a horse.

* * * * *